US008873786B2

(12) United States Patent
Larsen et al.

(10) Patent No.: US 8,873,786 B2
(45) Date of Patent: Oct. 28, 2014

(54) RETAINING MODULE FOR THE EARPIECE OF A HEARING AID

(75) Inventors: Tina Ahlberg Larsen, Birkerød (DK); Jørgen Mejner Olsen, Hillerød (DK)

(73) Assignee: Widex A/S, Lynge (DK)

( * ) Notice: Subject to any disclaimer, the term of this patent is extended or adjusted under 35 U.S.C. 154(b) by 195 days.

(21) Appl. No.: 13/080,634

(22) Filed: Apr. 5, 2011

(65) Prior Publication Data

US 2011/0182454 A1 Jul. 28, 2011

Related U.S. Application Data

(63) Continuation-in-part of application No. PCT/DK2008/000355, filed on Oct. 10, 2008.

(51) Int. Cl.
*H04R 25/00* (2006.01)
*H04R 1/10* (2006.01)

(52) U.S. Cl.
CPC ..... *H04R 25/656* (2013.01); *H04R 1/105* (2013.01); *H04R 25/652* (2013.01)
USPC ..... 381/328; 381/330

(58) Field of Classification Search
CPC ..... H04R 25/02; H04R 25/60; H04R 25/65; H04R 25/658; H04R 2225/63
USPC ..... 381/322–331, 380–382
See application file for complete search history.

(56) References Cited

U.S. PATENT DOCUMENTS 1,753,817 A 4/1930 Aber
5,712,453 A 1/1998 Bungardt et al.
7,412,068 B2 * 8/2008 Bayer ..... 381/328
8,121,325 B2 * 2/2012 Atamaniuk et al. ..... 381/322
2003/0174853 A1 9/2003 Howes et al.
2005/0008180 A1 * 1/2005 Smith et al. ..... 381/328
2007/0116309 A1 * 5/2007 Smith ..... 381/313

(Continued)

FOREIGN PATENT DOCUMENTS

DE 29718483 U1 2/1999
DE 100 50 766 A1 5/2001

(Continued)

OTHER PUBLICATIONS

Office Action for Japanese Patent Application No. 2011-513875 dated Jul. 31, 2012.

(Continued)

*Primary Examiner* — Ahmad Matar
*Assistant Examiner* — Katherine Faley
(74) *Attorney, Agent, or Firm* — Sughrue Mion, PLLC

(57) ABSTRACT

A retaining module (5) for retaining an earpiece in an ear comprises an annular sleeve (6) having a central aperture (7) adapted for receiving and holding at least a part of the earpiece. The retaining module (5) further comprises a first retaining member (8) adapted for engaging at least a part of the concha of the ear and having a proximal end (9) connected to said annular member (6) at a first location, and a strut member (10) having a proximal end (11) connected to said annular member (6) at a second location, and a distal end connected (13) to the distal end (12) of said first retaining member (8). The invention further provides a hearing aid comprising a retaining module, and a method of manufacturing a combination of a retaining module and an earpiece.

20 Claims, 9 Drawing Sheets

(56) References Cited

U.S. PATENT DOCUMENTS

| | | | | |
|---|---|---|---|---|
| 2009/0041279 | A1* | 2/2009 | Davis | 381/328 |
| 2009/0123010 | A1* | 5/2009 | Cano et al. | 381/318 |
| 2009/0226025 | A1* | 9/2009 | Howes et al. | 381/380 |
| 2009/0304216 | A1* | 12/2009 | Hansen | 381/324 |

FOREIGN PATENT DOCUMENTS

| | | | |
|---|---|---|---|
| GA | 10050766 | A1 | 5/2001 |
| JP | 2001-333484 | | 11/2001 |
| WO | 0150813 | A2 | 7/2001 |
| WO | 0245390 | A1 | 6/2002 |
| WO | 2004100508 | A1 | 11/2004 |
| WO | 2006/056198 | A2 | 6/2006 |
| WO | 2008147215 | A1 | 12/2008 |
| WO | 2010031775 | A1 | 3/2010 |

OTHER PUBLICATIONS

EP Communication for EP2332343 dated Apr. 3, 2012.
Best Overall Workout Headphones of 2011—Article—downloaded Aug. 14, 2012.
Best Gym Headphones of 2011—Article downloaded Aug. 14, 2012.
International Search Report for PCT/DK2008/000355 dated Jun. 23, 2009.

* cited by examiner

RETAINING MODULE FOR THE EARPIECE OF A HEARING AID

RELATED APPLICATIONS

The present application is a continuation-in-part of application No. PCT/DK2008000355, filed on Oct. 10, 2008, in Denmark and published as WO2010040350 A1.

BACKGROUND OF THE INVENTION

1. Field of the Invention

The present invention relates to hearing aids. The invention more specifically relates to a retaining module for retaining an earpiece in an ear, as well as to a hearing aid using such a retaining module. In particular, but not exclusively, the present invention relates to a retaining module for holding an earpiece of a hearing aid at an appropriate place in the ear, e.g. in the ear canal or in the concha of the ear. The invention further relates to a method of manufacturing.

As the name suggests, Behind-The-Ear (BTE) hearing aids are worn behind the ear. To be more precise, an electronics unit comprising a housing containing the major electronics parts thereof, is worn behind the ear. An earpiece for emitting sound to the hearing aid user is worn in the ear, e.g. in the concha or the ear canal thereof. In a traditional BTE hearing aid, a sound tube is used because the output transducer, which in hearing aid terminology is normally referred to as the receiver, is located in the housing of the electronics unit. In some modern types of hearing aids a conducting member comprising electrical conductors is used, because the receiver is placed in the earpiece in the ear. Such hearing aids are commonly referred to as Receiver-In-The-Ear (RITE) hearing aids.

In particular when the earpiece is not inserted firmly in the ear canal of the hearing aid user, it is a problem to secure and keep the earpiece in the correct position in the ear.

2. Prior Art

In this respect, DE-U-29718483 discloses various embodiments of a holding device for earpieces of inter alia hearing aids. Generally, the various embodiments are composed of C and T shaped resilient retaining members and combinations thereof, the retaining members engaging various parts of the ear, allowing the earpiece to "float" freely in the concha, i.e. with only the retaining members engaging the ear. The various embodiments are interchangeable with respect to the earpiece, but how the earpiece is in fact connected to the holding device is not disclosed.

SUMMARY OF THE INVENTION

Based on this, it is a feature of the present invention to provide a holding device with improved means for engaging the earpiece, improved retaining capabilities with respect to the ear and good wearing comfort.

The invention, in a first aspect, provides a retaining module for retaining an earpiece in an ear, said retaining module comprising an annular sleeve having a central aperture adapted for receiving and holding at least a part of said earpiece, a first retaining member adapted for engaging at least a part of the concha of the ear, a second retaining member, and a strut member, wherein said first retaining member, said second retaining member and said strut member essentially extend in one common plane, said first retaining member has a proximal end connected to said annular member at a first location, and said strut member has a proxi-mal end connected to said annular member at a second location and a distal end connected to the distal end of said first retaining member, and wherein said central aperture of said annular sleeve has a longi-tudinal axis extending essentially in parallel with said common plane.

Constructing the retaining module in this way creates a closed topology, where the first retaining member and the strut member both support the annular sleeve, and thus the earpiece placed therein, thereby providing an improved resistance against dislocation or twisting of not only the retaining module itself, but also the earpiece as such, with respect to the ear.

According to an embodiment, said retaining module further comprises a second retaining member adapted for engaging at least a part of the ear spaced from the concha. Having a second retaining member further improves the resistance of the retaining module itself as well as the earpiece as such, with respect to the ear.

According to a further embodiment, said second retaining member has a proximal end and a distal end, the proximal end of said second retaining member being connected to the distal end of said first retaining member and to the distal end of said strut member. Thereby it is possible to effectively shape the second member to facilitate an improved engagement with said other part of the ear.

According to yet another embodiment, said proximal end of said first retaining member and the proximal end of said strut member are connected to essentially diametrically opposite sides of said annular sleeve. Having these arranged symmetrically improves resistance of the retaining module against undesired movements and twisting of the earpiece, as the mass of the earpiece may be evenly distributed on either side of the plane, in which the first retaining member, said second retaining member and said strut member preferably extend.

Arranging the central aperture of said annular sleeve with a longitudinal axis extending essentially in parallel with said common plane facilitates the achievement of a proper location of the mass distribution of the ear piece, but also allows the sound output port to be directed towards, but not into, the ear canal.

According to yet another embodiment, said strut member has an arched section adapted for avoiding contact with the crus helicis of the ear. Avoiding contact with the crus helicis is important from a user viewpoint, as the retaining module may otherwise be uncomfortable to wear. Moreover, such curvature turns out to be advantageous when it comes to the rigidity of the retaining module in the plane.

According to a further embodiment, said second retaining member is adapted for engaging at least a part of the crus antihelix of the ear. Using crus antihelix for engagement provides further resistance of the retaining module against dislocation and also allows for a simple construction of the retaining module, as the second retaining member can be made as a natural extension of the first retaining member.

According to yet another embodiment, said second retaining member is adapted for engaging at least a part of the fossa of helix of the ear. Using the fossa of helix for engagement provides further resistance of the retaining module against dislocation and also allows for a simple construction of the retaining module, as the second retaining member can be made as a further natural extension of the second retaining member in the direction away from the first retaining member.

According to a further embodiment, said second retaining member is adapted for engaging at least a part of the helix of the ear. Using the helix of the ear for engagement provides further resistance of the retaining module against dislocation and also allows for a simple construction of the retaining module, as the second retaining member can be made as a further natural extension of the second retaining member in the direction away from the first retaining member.

In yet a further embodiment, the first retaining member and the second retaining member are adapted to provide a smooth transition without any discontinuity at the point where the proximal end of said second retaining member is connected to the distal end of said first retaining member. This improves wearing comfort and fits the natural curvature of those parts of the ear, which the retaining members engage.

According to an embodiment, at least one of the first retaining member, the second retaining member and the strut has an essentially oval or elliptical cross-section. Having an oval or elliptical cross-section, rather than e.g. a circular one, imparts in the retaining member a propensity to flex in one plane, which stabilizes the seating and improves wearing comfort. The wearing comfort is even further improved when the distal end of the second retaining member is rounded.

Preferably, the cross-sectional dimensions of at least one of the first retaining member, the second retaining member and the strut is essentially constant over the length thereof, the largest dimension of said cross section being at least 0.5 mm, not more than 2 mm, and preferably approximately 1.5 mm. This allows the retaining members and thus the entire retaining module to appear inconspicuous.

According to another embodiment, the retaining module is manufactured in one integral piece of material. This is advantageous as it furthermore allows the retaining module to be manufactured by injection moulding or transfer moulding.

According to a further embodiment, the material is an elastic material with a Shore A hardness in the interval from 50 to 90, preferably approximately 80. This ensures sufficient retaining capabilities of the retaining module without compromising wearing comfort.

The invention, in a second aspect, provides a hearing aid comprising a retaining module for retaining an earpiece in an ear, said retaining module having an annular sleeve having a central aperture adapted for receiving and holding at least a part of said earpiece, a first retaining member adapted for engaging at least a part of the concha of the ear, and a strut member, wherein said first retaining member has a proximal end connected to said annular member at a first location, and wherein said strut member has a proximal end connected to said annular member at a second location, and a distal end connected to the distal end of said first retaining member.

The invention, in a third aspect, provides a method of manufacturing a combination of a retaining module and an earpiece, comprising injection molding a retaining module, said retaining module having an annular sleeve having a central aperture adapted for receiving and holding at least a part of said earpiece, a first retaining member adapted for engaging at least a part of the concha of the ear, and a strut member, wherein said first retaining member has a proximal end connected to said annular member at a first location, and wherein said strut member has a proximal end connected to said annular member at a second location, and a distal end connected to the distal end of said first retaining member selecting an ear piece, joining the retaining module with the ear piece, and placing the ear piece in the sleeve, the sleeve holding the ear piece by resilience and friction.

BRIEF DESCRIPTION OF THE DRAWINGS

The invention will now be described in greater detail based on non-limiting exemplary embodiments and the appended drawings. In the drawings

DETAILED DESCRIPTION OF THE INVENTION

Figure 1:
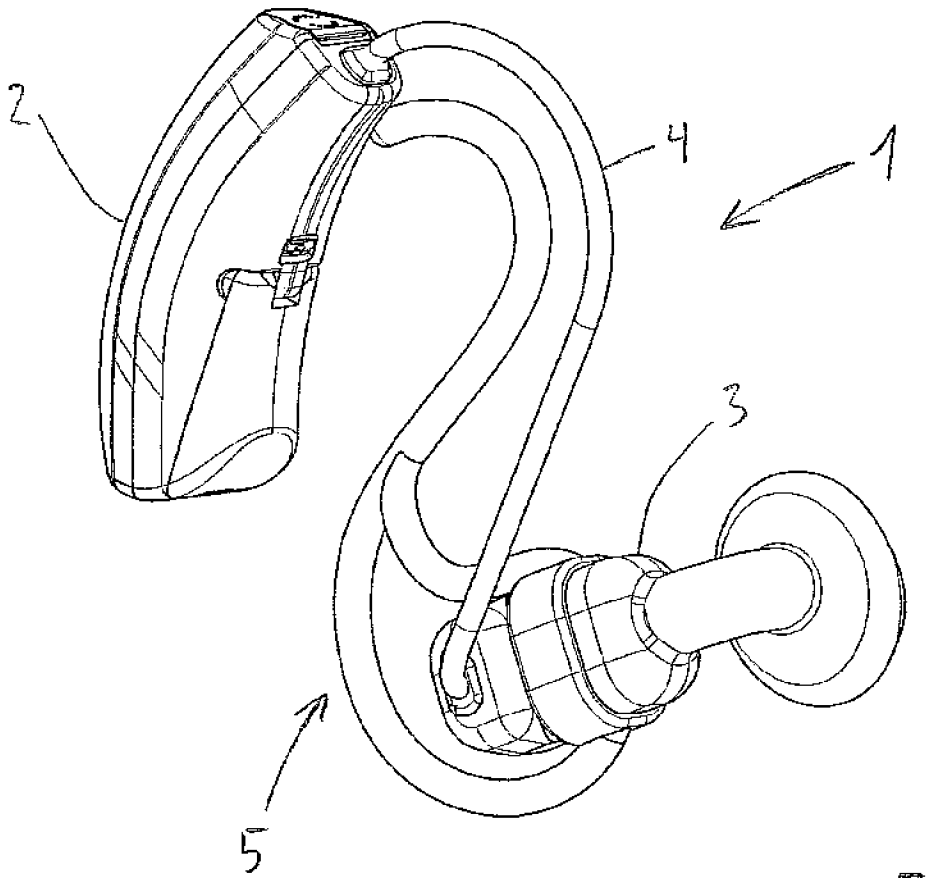
FIG. 1 illustrates a RITE hearing aid with a retaining module according to an embodiment of the invention mounted on the earpiece.
Figure 9:
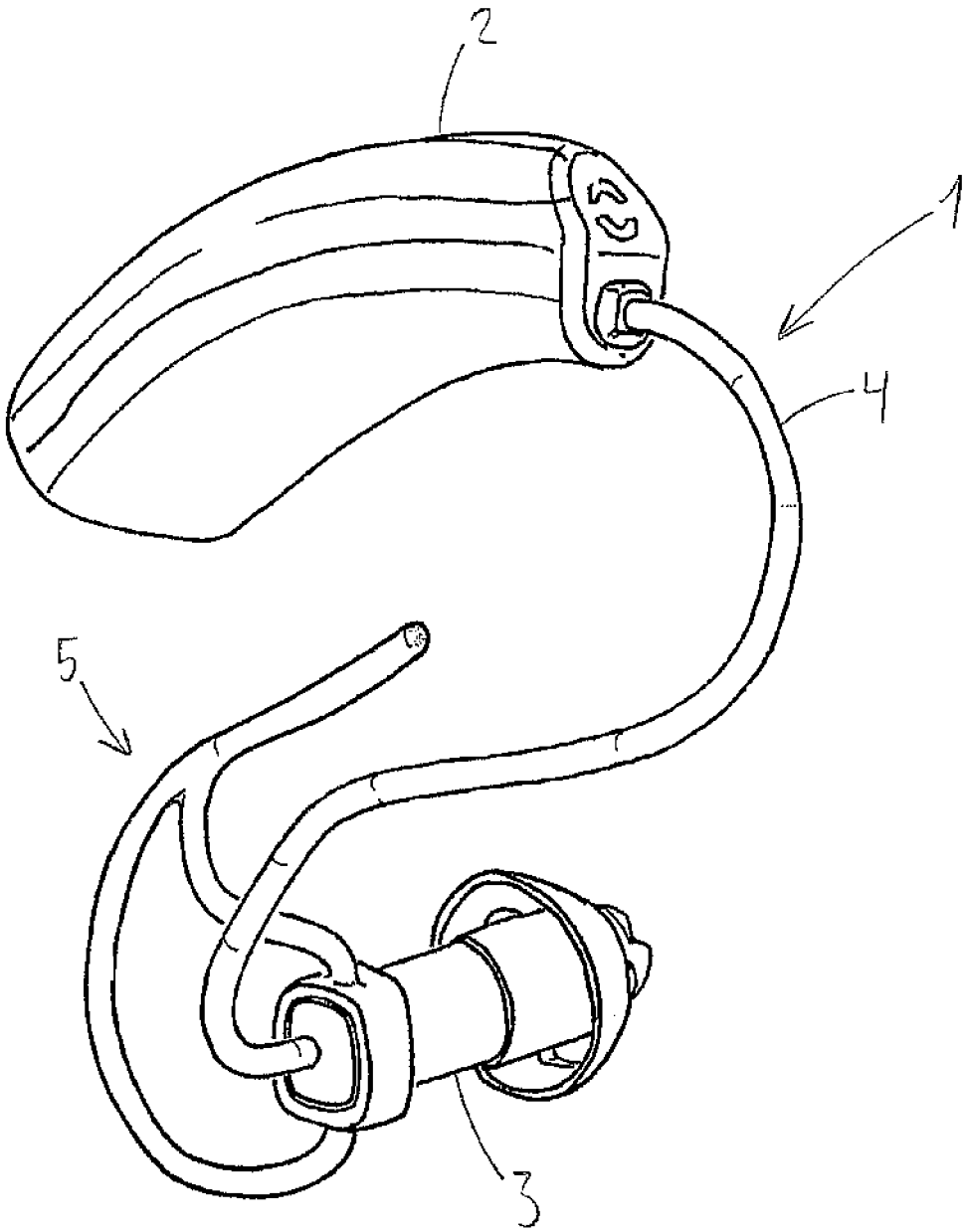
FIG. 9 illustrates a RITE hearing aid with the retaining module according of FIG. 7 mounted on the earpiece.

FIGS. 1 and 9 both show a hearing aid 1 of the RITE type. The hearing aid 1 of FIG. 1 has a housing 2, which is shaped to be placed behind an ear. The illustrated hearing aid is of the RITE type, and it has an earpiece 3, which is connected to the electronics in the housing 1 by means of a conductor 4. The earpiece 3 is a part adapted to be placed at the auditory meatus, mainly in the concha and partially extending into the ear canal. For this purpose the earpiece 3 of FIG. 1 has a bent tubular portion leading to an ear bud. Likewise, the hearing aid 1 of FIG. 9 has a housing 2, which is shaped to be placed behind an ear. The illustrated hearing aid is of the RITE type, and it has an earpiece 3, which is connected to the electronics in the housing 1 by means of a conductor 4. The earpiece 3 is a part adapted to be placed at the auditory meatus, mainly in the concha and partially extending into the ear canal. For this purpose the earpiece 3 of FIG. 9 is held at an angle differing from that of FIG. 1 and does thus not have a bent tubular portion, but leads instead directly into an ear bud.

The present invention, however, does not relate to these parts but to a retaining module 5 mounted on the earpiece 3. The skilled person will thus understand that it is not important whether the earpiece is an earpiece of a BTE hearing aid 1 or a self contained hearing aid, i.e. an earpiece containing an entire hearing aid.

The retaining module 5 will now be described in greater detail with reference to various embodiments shown in the subsequent figures, where corresponding parts of different embodiments have same reference numerals.

Figure 2:
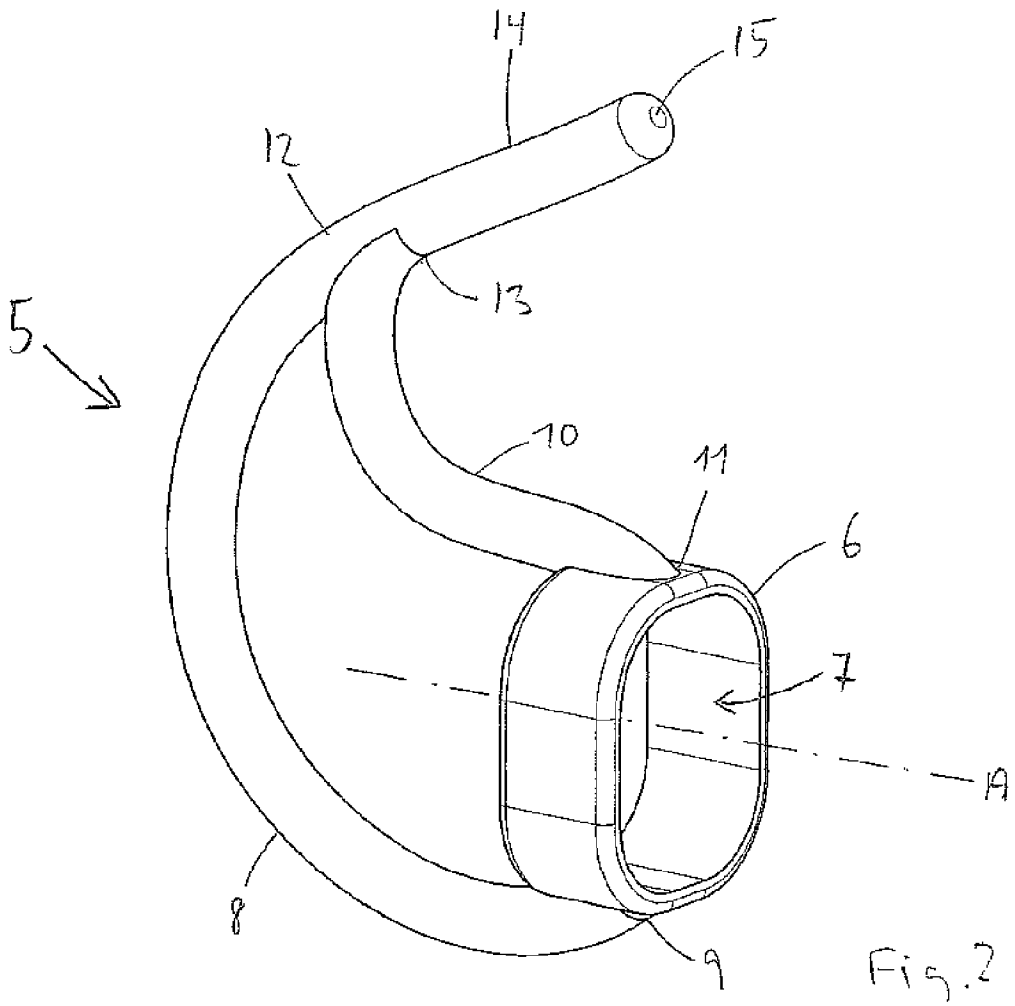
FIG. 2 illustrates a first embodiment of the retaining module according to an embodiment of the invention.

FIG. 2 shows a first embodiment of the retaining module 5 according to the invention. The retaining module 5 has an annular sleeve 6 adapted for receiving and holding at least a part of the earpiece 3 as seen in FIG. 1. The annular sleeve has a central aperture 7 extending in the direction of a longitudinal axis A. The sleeve 6 receives the earpiece 3 and holds it by resilience and friction.

In a modified embodiment the sleeve is permanently joined with the earpiece by gluing or welding. In another modified embodiment the sleeve is cast integrally with an outer portion of the earpiece.

A first retaining member 8 extends from one side of the outer surface of the annular sleeve 6, the proximal end 9 of the first retaining member 8 being connected to the annular sleeve 6. Also, from the outer surface of the annular sleeve 6, a strut member 10 extends, the proximal end 11 of the strut member 10 being connected to the annular sleeve 6. Preferably, the proximal end 9 of the first retaining member 8 and the proximal end 11 of the strut member are located diametrically opposite each other on the annular sleeve 6.

The distal end 12 of the first retaining member 8 and the distal end 13 of the strut member 10 are connected to each other, so as to form a closed loop including the annular sleeve 6. In the illustrated embodiment a second retaining member 14 extends from the closed loop, the proximal end of the second retaining member being connected to both the distal end 12 of the first retaining member 8 and the distal end of the strut member. The distal end 15 of the second retaining member is free. Preferably the distal end 15 of the second retaining member is rounded to improve wearing comfort.

The first retaining member 8, the strut member 10 and the second retaining member 14, preferably all lie in the same plane. Preferably, the axis A also lies in this plane. When, as described above, the proximal end 9 of the first retaining member 8 and the proximal end 11 of the strut member 10 are located diametrically opposite each other on the annular sleeve 6, the annular sleeve 6 extends symmetrically out of the plane. Thus, the mass of the earpiece to be held in the central aperture 7 will also largely be evenly distributed on either side of the plane and thus have a reduced tendency to wobble.

Preferably the entire retaining module 5 is made as one integral piece by a suitable process such as injection moulding or transfer moulding.

The material is an elastic biocompatible material such as silicone, fluorosilicone or thermoplastic elastomere (TPE), but the skilled person will know alternative materials to these. Elastic in this context means that the material has a Shore A hardness in the interval from 50 to 90, preferably approximately 80. Lower hardness gives a softer retainer and lower bias in the seat in the ear.

Preferably, the cross-sections of the first retaining member 8, the strut member 10 and the second retaining member 14 are identical. The cross-section may be circular but is preferably oval or elliptical as this turns out to improve wearing comfort. The largest cross sectional dimension is at least 0.5 mm, at most 2 mm, and preferably approximately 1.5 mm. This renders the appearance of the retaining member quite inconspicuous, in particular when the retaining module is made of a transparent material such as silicone.

The particular dimension will be selected depending on the material and as appropriate to achieve the desired flexibility, larger cross sections yielding a sturdier retainer. One preferred embodiment has a retainer with a cross section of 1.5 mm and a material with a hardness of 80 Shore A. Another preferred embodiment has a retainer with a cross section of 2.0 mm and a material with a hardness of 40 Shore A. Still another preferred embodiment has a retainer with a cross section of 1.0 mm and a material with a hardness of 65 Shore D, equivalent to more than 90 Shore A. In still other embodiments the cross section could be varied along the length to adapt the bias force on the ear.

Figure 3:
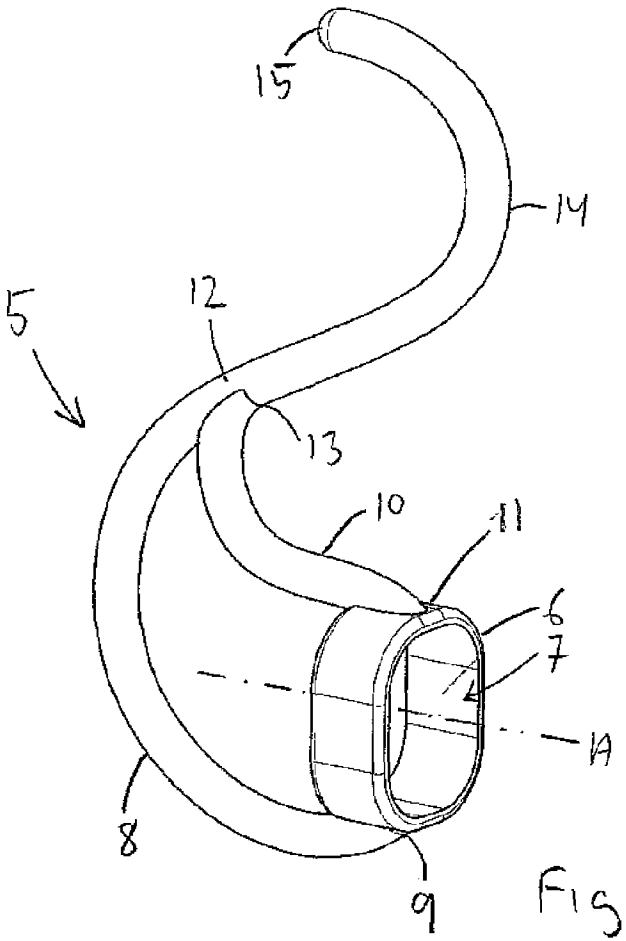
FIG. 3 illustrates a second embodiment of the retaining module of the embodiment of the invention.

FIG. 3 illustrates a second embodiment of the retaining module according to the invention. It differs however only from the embodiment of FIG. 2 in that the second retaining member is longer. The reason for this will be explained further below.

Figure 4:
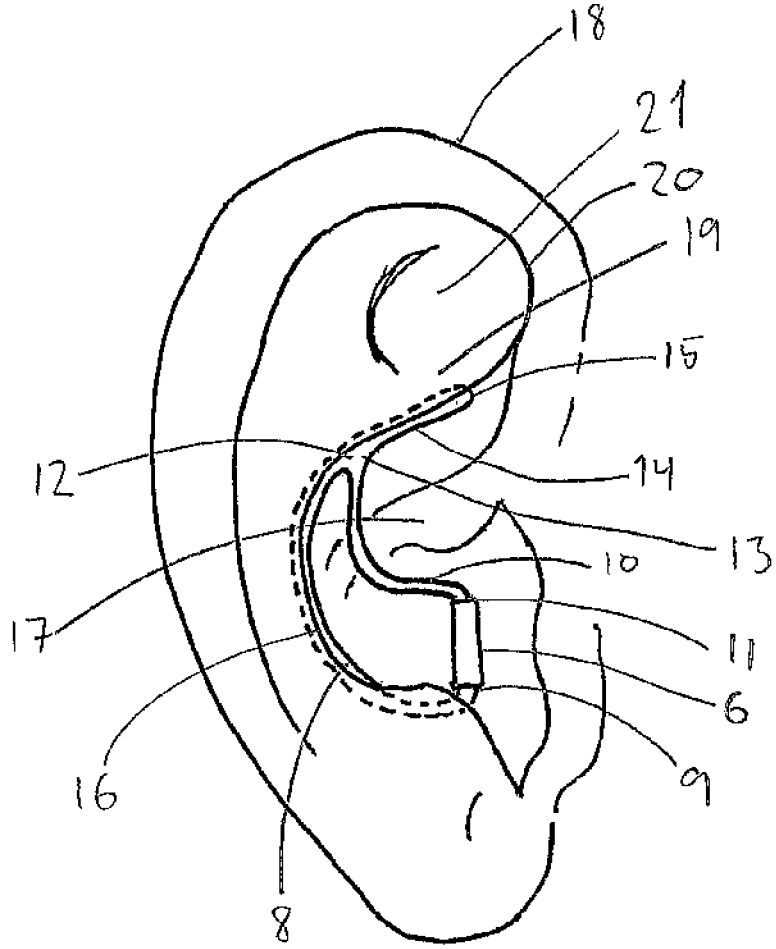
FIG. 4 illustrates the first embodiment of the retaining module placed in an ear.

Turning now to FIG. 4, it can be seen that the first retaining member 8 has a curvature, which adapts it for engaging the concha 16 of the ear, more specifically the edge thereof. It can also be seen that the strut member 10 has a curvature in the same direction. The curvature of the strut member has two functions. One is to provide a spring bias for keeping the distal end 9 and proximal end 12 of the first retaining member at fixed positions with respect to each other. Thus, when inserting the retaining module 5 in the concha 16, the distal end 12 and the proximal end 9 are pressed towards each other. At the same time the distal end 12 and the proximal end 11 of the strut member 10 are also pressed towards each other. When released in the ear, the inherent elastic properties of the first retaining member 8 will try to return it to its natural relaxed shape, thereby forcing it into engagement with the concha 16 of the ear. The same happens for the strut member 10, which creates a bias because the distal end 13 is connected to the distal end 12 of the first retaining member 8, and because the proximal end 11 is connected to the proximal end 9 of the first retaining member 8 via the annular sleeve 6, which in comparison is rigid, because of the earpiece inserted therein. The strut member 10 thus aids in forcing the first retaining member 8 into engagement with the concha 16 of the ear. The other reason for the curvature is to avoid contact between the strut member 10 and the crus helicis 17 of the ear, so as improve wearing comfort.

To further improve the engagement with the concha 16, the second retaining member 14 is adapted to provide a smooth extension of the first retaining member 8, and has a curvature allowing it to press slightly against the concha 16 in the inserted position.

Figure 5:
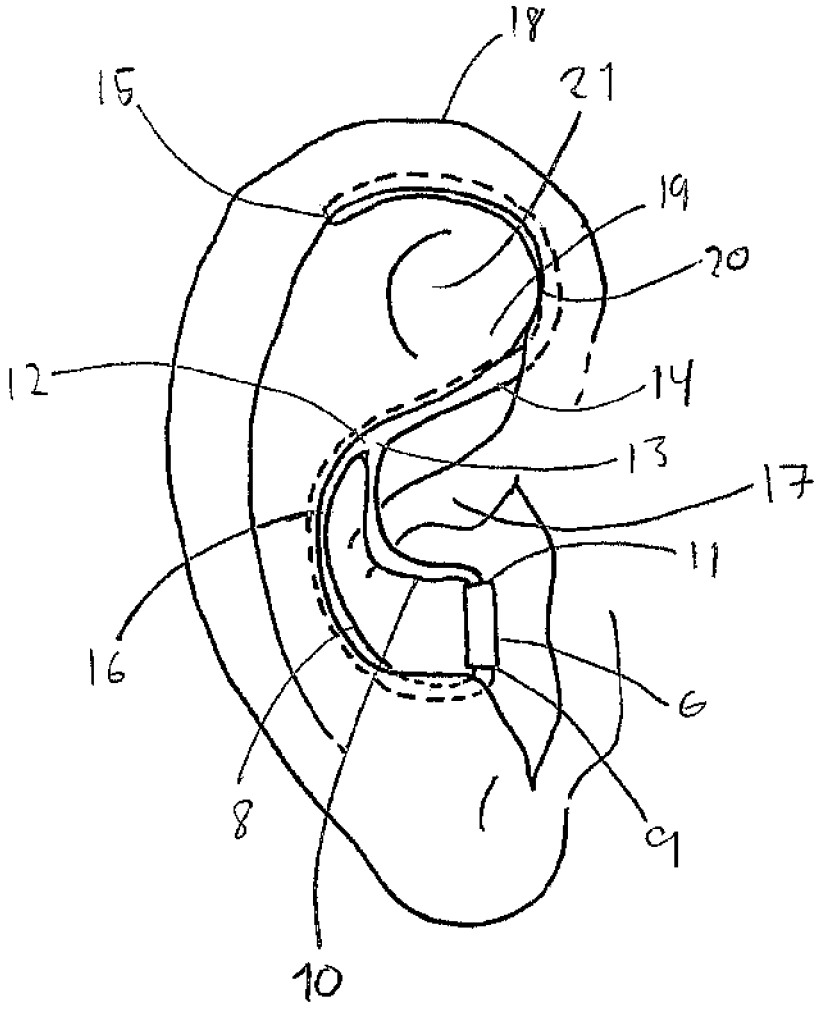
FIG. 5 illustrates the second embodiment of the retaining module placed in an ear.

As can be seen from FIG. 5, the second retaining member 14 may extend further allowing it to engage the helix 18 of the ear and be adapted for engaging at least a part of the crus antihelix 19 of the ear, preferably in the fossa of helix 20 of the ear, where it can lie in an inconspicuous way.

Figure 6:
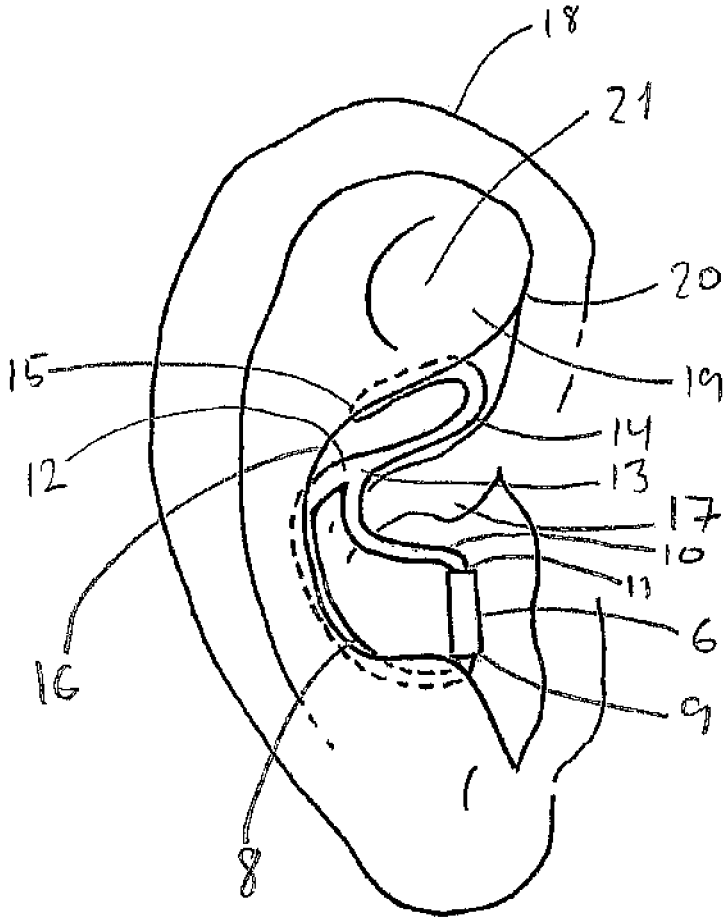
FIG. 6 illustrates a third embodiment of the retaining module placed in an ear.

As can be seen in FIG. 6, the second retaining member 14 may be bent backwardly in shape, so as to point in the opposite direction when it is in engagement with the concha 16 of the ear, as compared to FIG. 4.

In a further variant (not shown), the second retaining member 14 may also have a backwardly bent shape so as to emerge from the fossa of helix 19 into the fossa triangularis 21.

Figure 7:
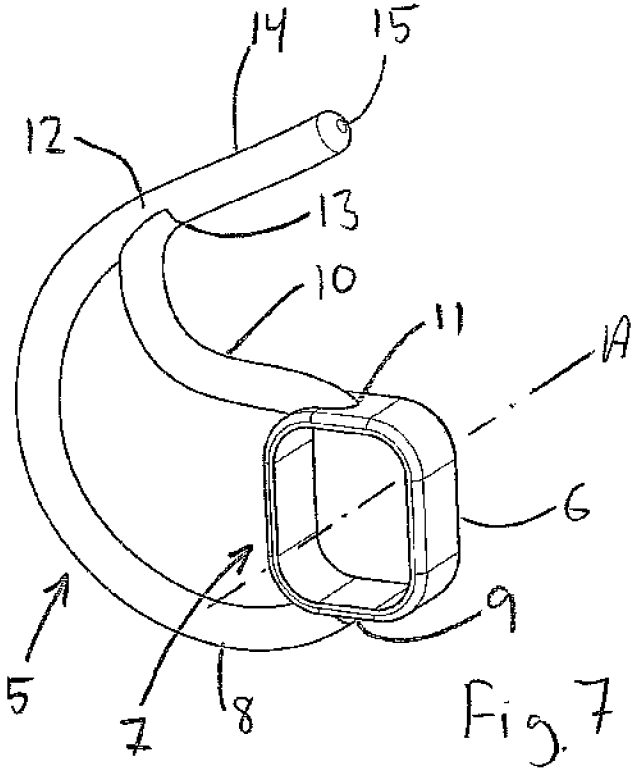
FIG. 7 illustrates a fourth embodiment of the retaining module according to the invention.
Figure 8:
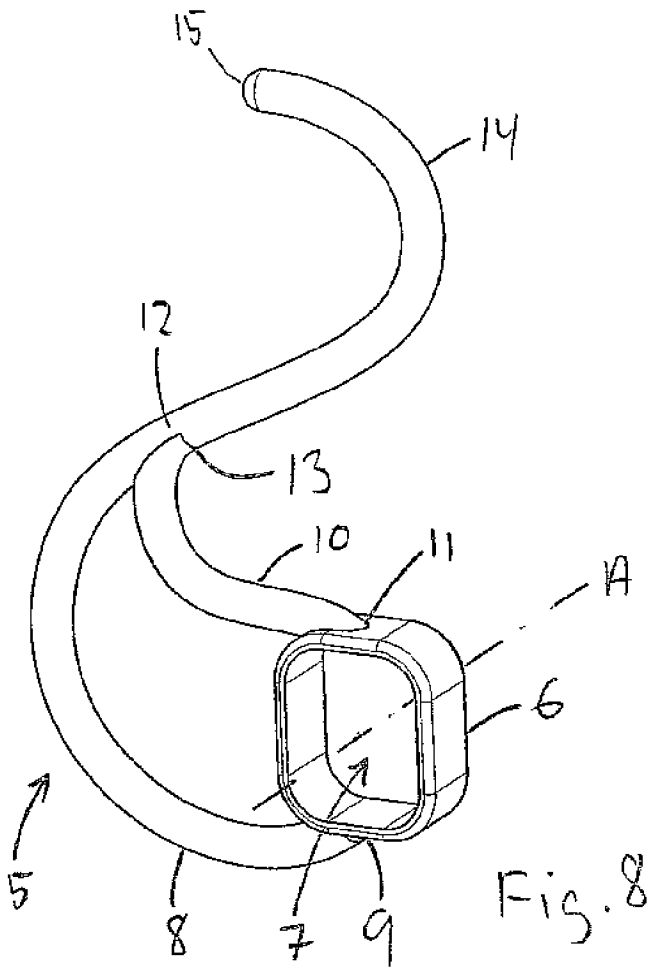
FIG. 8 illustrates a fifth embodiment of the retaining module according to the invention.

FIGS. 7 and 8 show different embodiments of the invention suited for earpieces that are adapted for a seat somewhat deeper in the auditory canal. The embodiments of FIGS. 7 and 8 essentially differ only from the previously described embodiments in that the annular sleeve 6 has been turned 90 degrees, that is the central axis A of the annular sleeve is perpendicular to the plane in which the first retaining member 8, the second retaining member 14 and the strut member 10 lie. Accordingly, all other features of the previously described embodiments may freely be implemented in these embodiments too.

Having the central axis A at a different angle facilitates the use of other types of earpieces than the above-mentioned "floating" earpieces, e.g. earpieces 3 comprising earplugs as illustrated in FIG. 9 adapted to be inserted into the ear canal of the user.

The present invention has now been explained based on illustrative exemplary embodiments. The skilled person will know, however, that numerous modifications are possible within the scope of invention as set out in the claims, e.g. in terms of shapes and dimensions but also choice of materials and material properties.

We claim:

1. A retaining module for retaining in an ear a Receiver-In-The-Ear (RITE) earpiece containing a receiver, said retaining module comprising an annular sleeve having a central aperture sized and positioned to receive and hold at least a part of said RITE earpiece, a first retaining member adapted for engaging at least a part of the concha of the ear, a second retaining member, and a strut member, wherein said first retaining member, said second retaining member and said strut member essentially extend in one common plane, said first retaining member has a proximal end connected to said annular sleeve at a first location, and said strut member has a proximal end connected to said annular sleeve at a second location and a distal end connected to the distal end of said first retaining member, and wherein, when said retaining module is free of external bending forces, said central aperture of said annular sleeve has a longitudinal axis extending essentially in parallel with said common plane.

2. The retaining module according to claim 1, wherein said second retaining member is adapted for engaging at least a part of the ear spaced from the concha.

3. The retaining module according to claim 1, wherein said second retaining member has a proximal end and a distal end, the proximal end of said second retaining member being connected to the distal end of said first retaining member and to the distal end of said strut member.

4. The retaining module according to claim 3, wherein said first retaining member and said second retaining member are adapted to provide a smooth transition without any discontinuity at a point where the proximal end of said second retaining member is connected to the distal end of said first retaining member.

5. The retaining module according to claims 3, wherein the distal end of the second retaining member is rounded.

6. The retaining module according to claim 1, wherein said proximal end of said first retaining member and said proximal end of said strut member are connected to essentially diametrically opposite sides of said annular sleeve.

7. The retaining module according to claim 1, wherein said strut member has an arched section adapted for avoiding contact with the crus helicis of the ear.

8. The retaining module according to claim 1, wherein said second retaining member is adapted for engaging at least a part of the crus antihelix of the ear.

9. The retaining module according to claim 1, wherein at least one of the first retaining member, the second retaining member and the strut has an essentially oval or elliptical cross-section.

10. The retaining module according to claim 1, wherein a cross sectional dimension of at least one of the first retaining member, the second retaining member and the strut is essentially constant over the length thereof, the largest dimension of said cross section being at least 1 mm, and at most 2 mm.

11. The retaining module according to claim 1, wherein the retaining module is manufactured in one integral piece of material.

12. The retaining module according to claim 11, wherein the material is an elastic material with a Shore A hardness in the interval from 50 to 90.

13. The retaining module according to claim 1 wherein the retaining module is manufactured by injection moulding or transfer moulding.

14. The retaining module according to claim 1, wherein the retaining module is permanently joined with at least an outer part of the earpiece.

15. The retaining module according to claim 1, wherein said central aperture is adapted to hold said at least part of said earpiece such that said earpiece extends out of said aperture and then toward an ear canal.

16. A hearing aid comprising a retaining module for retaining in an ear a Receiver-In-The-Ear (RITE) earpiece containing a receiver, said retaining module having an annular sleeve having a central aperture sized and positioned to receive and hold at least a part of said earpiece, a first retaining member adapted for engaging at least a part of the concha of the ear, and a strut member, wherein said first retaining member has a proximal end connected to said annular sleeve at a first location, and wherein said strut member has a proximal end connected to said annular sleeve at a second location, and a distal end connected to the distal end of said first retaining member, and a longitudinal axis of said central aperture, in the absence of external bending forces, lies in a plane essentially parallel to a plane in which said first retaining member and strut member extend.

17. The hearing aid comprising a retaining module according to claim 16, wherein said first retaining member, a second retaining member and said strut member essentially extend in one common plane.

18. The hearing aid according to claim 16, wherein said central aperture is adapted to hold said at least part of said earpiece such that said earpiece extends out of said aperture and then toward an ear canal.

19. A method of manufacturing a combination of a retaining module and a Receiver-In-The-Ear (RITE) earpiece containing a receiver, said method comprising injection molding a retaining module, said retaining module having an annular sleeve having a central aperture sized and positioned to receive and hold at least a part of said RITE earpiece, a first retaining member adapted for engaging at least a part of the concha of the ear, and a strut member, wherein said first retaining member has a proximal end connected to said annular sleeve at a first location, and wherein said strut member has a proximal end connected to said annular sleeve at a second location, and a distal end connected to the distal end of said first retaining member, and a longitudinal axis of said central aperture, in the absence of external bending forces, lies in a plane essentially parallel to a plane in which said first retaining member and strut member extend, selecting a RITE earpiece, joining the retaining module with the earpiece, and placing the earpiece in the annular sleeve, the annular sleeve holding the earpiece by resilience and friction.

20. The method according to claim 19, wherein said central aperture is adapted to hold said at least part of said earpiece such that said earpiece extends out of said aperture and then toward an ear canal.

* * * * *